United States Patent [19]

Riedel

[11] 4,453,290

[45] * Jun. 12, 1984

[54] LEVER-OPERABLE FASTENER

[75] Inventor: Tilo H. Riedel, Salzburg, Austria

[73] Assignee: Sesamat Anstalt, Schaan, Liechtenstein

[ * ] Notice: The portion of the term of this patent subsequent to Apr. 27, 1999 has been disclaimed.

[21] Appl. No.: 208,627

[22] Filed: Nov. 20, 1980

[51] Int. Cl.³ ..... A43C 11/00; A44B 21/00

[52] U.S. Cl. ..... 24/70 SK; 24/68.5 K

[58] Field of Search ..... 24/70 SK, 70 R, 70 T, 24/70 CT, 70 TT, 70 ST, 71 R, 71 T, 71 ST, 71 TT, 71 SB, 71 A, 71 TD, 71 CT, 71 SK, 68 SK, 68 R, 69 R, 69 SK, 69 ST, 206 B; 36/50; 254/245, 246, 247, 256, 258, 259, 260

[56] References Cited

U.S. PATENT DOCUMENTS

| | | | |
|---|---|---|---|
| 3,662,435 | 5/1972 | Allsop | 24/70 SK |
| 4,011,634 | 3/1977 | Olivieri | 24/70 SK |
| 4,310,951 | 1/1982 | Riedel | 24/70 SK |
| 4,326,320 | 4/1982 | Riedel | 24/70 SK |

*Primary Examiner*—John J. Wilson
*Attorney, Agent, or Firm*—Kurt Kelman

[57] ABSTRACT

A lever-operable fastener for pulling two parts of a skiing boot toward each other comprises a rack (1), which is secured to one of said parts and adapted to receive a tensioning lever (2). A tensile element (3) is connected to the other of said parts and acts on said tensioning lever at a point which is spaced from a detent element (4), which is provided on the tensioning lever (2) and is adapted to extend into a tooth space of said rack (1) so as to define a fulcrum for said lever. In order to permit a retensioning of said fastener without a previous reduction of the closing tension which has been applied before, the tensioning lever (2) comprises two detent elements (4, 5), each of which is adapted to define a fulcrum for said lever and which during an upswing and downswing of said lever successively enter said rack (1) whereas the detent element (4 or 5) which is clear of said rack at a time is advanced into the next following tooth space of said rack (1) in the tensioning direction during such upswing and downswing of said lever (FIG. 1).

13 Claims, 22 Drawing Figures

Figure 5:
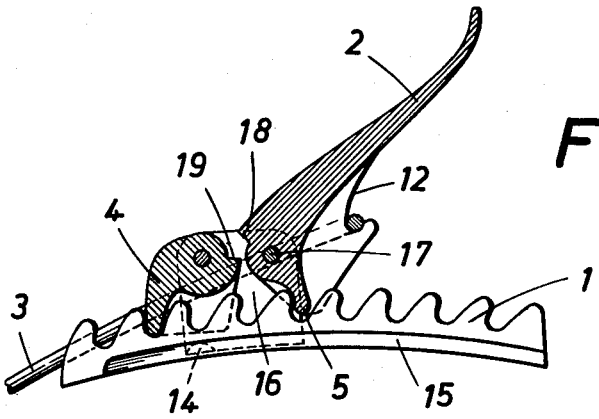

FIG.1
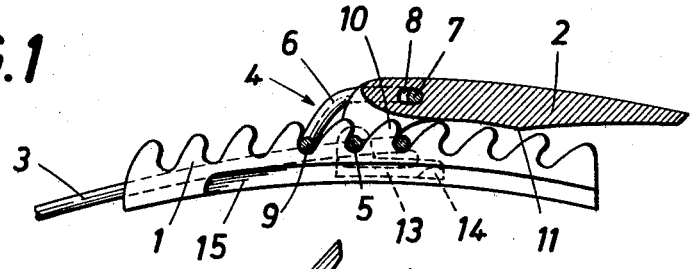
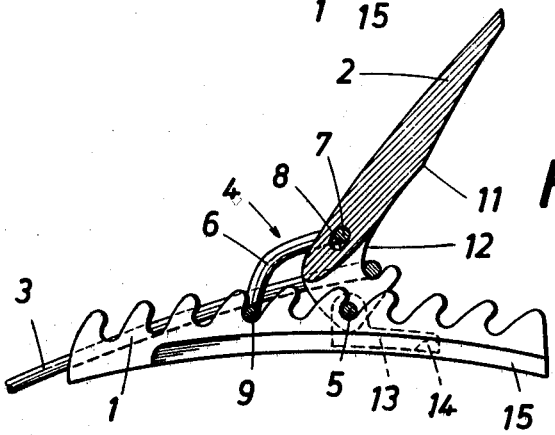
FIG.2
FIG.3
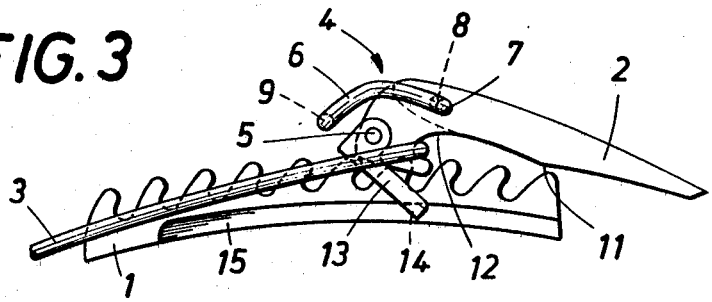
FIG.4
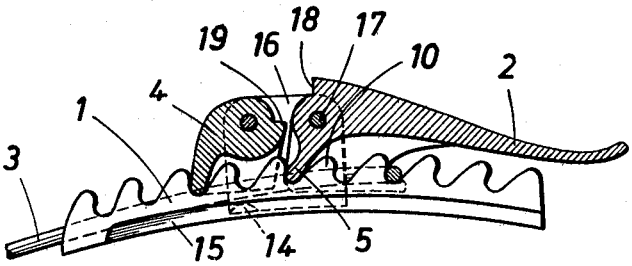

FIG. 20
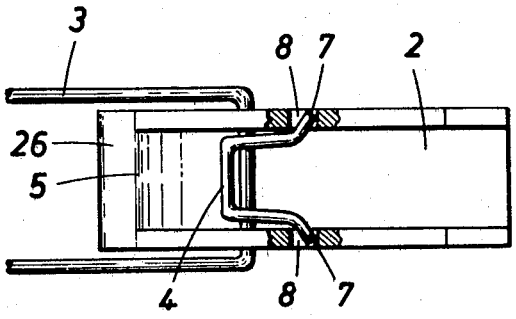
FIG. 21
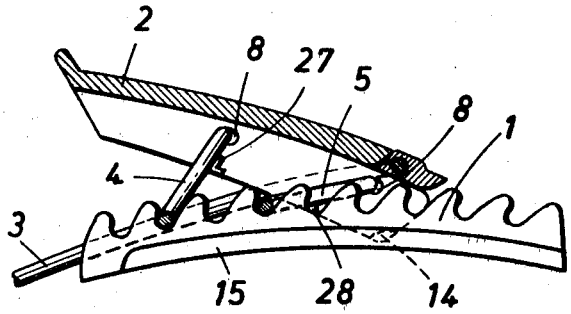
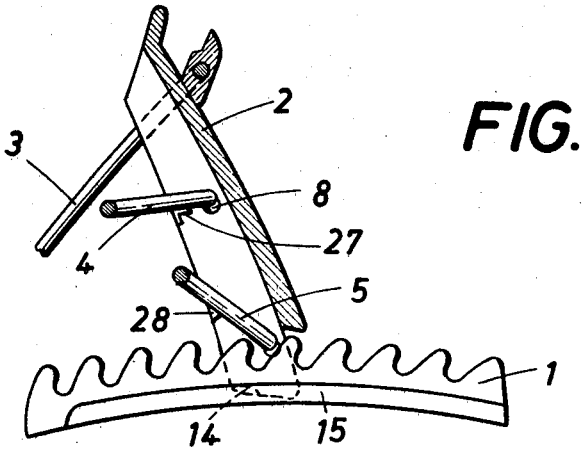
FIG. 22

LEVER-OPERABLE FASTENER

This invention relates to a lever-operable fastener for a shoe, particularly a skiing boot, comprising a rack secured to one of the two shoe parts to be joined by the fastener, a tensioning lever adapted to interengage with said rack, a tensile element connected to the other of said two parts and acting on said lever at a distance from a detent element which is provided on said lever and adapted to interengage with the rack to define a fulcrum for said lever.

In known lever-operable fasteners of this kind, which are also called tightener-operable fasteners, the detent element of the tensioning lever is interengaged with the rack and the lever is then actuated by a pivotal movement about the fulcrum defined by the detent element. Because the tensile element consisting usually of a loop acts on the tensioning lever at a distance from its fulcrum, the pivotal movement of the tensioning lever will cause that part of the shoe which is connected to the tensile element to be pulled toward the other of said parts, which carries the rack, so that the shoe is closed. In that case the tension in the closed shoe will depend on the position of the detent element in the rack and can be changed as required in that the tensioning lever is placed into a different tooth space of the rack. For this purpose the fastener must be entirely opened and be relieved of the previously applied tension. This is considered a disadvantage.

In an endeavor to permit a retensioning of the fastener without a need to previously relieve the tension applied before, a lever-operable fastener has been disclosed in which the tensioning lever is mounted in a bearing bracket, which is secured to one of the two parts to be closed and which adjacent to its pivotal axis constitutes a pinion, which is in mesh with mating teeth provided on a straplike tensile element connected to the other part of the shoe so that a pivotal movement of the tensioning lever will move the tensile element. In such fastener the tensioning lever will slip freely during the swingback movement which is opposite to the tensioning movement; this free slip is permitted because the pinion is lifted from the tensile element strap. In order to ensure that the previously applied tension will not be lost as the pinion slips during the swingback movement of the tensioning lever, restraining ratchet-and-pawl mechanism is provided, which retains the tensile element strap during the swingback movement of the tensioning lever and permits the tensioning lever to move only in the tensioning direction. It will be understood that said restraining ratchet-and-pawl mechanism must be released when it is desired to open the fastener; this requirement adds to the structural expenditure involved in that lever-operable fastener. It is felt that a special disadvantage inherent in the use of that fastener resides in that tensile element must be threaded into the bearing bracket so that the fastener cannot be closed simply in that the tensile element is interengaged with the rack. Besides, biasing springs having a high breaking strength are required for the driving and restraining ratchet-and-pawl mechanisms.

It is an object of the invention to avoid these disadvantages and so to improve a lever-operable fastener of the kind described first hereinbefore that a fastener involving only a low structural expenditure can be retensioned without a need to relieve the previously applied tension.

This object is accomplished in accordance with the invention in that the tensioning lever is provided with two detent elements, which are adapted to define respective fulcrums for said lever and which during its upswing and downswing successively interengage with the rack so that the detent element which is clear of the rack at a time is advanced in the tensioning direction into a succeeding tooth space of the rack. As a result of this feature the tensioning lever can simply be inserted into the rack, as is usual in a tightener-operable fastener, and without a need to take the final tesnion to be applied into consideration. As the tensioning lever is swung up and down, it is advanced on the rack in the tensioning direction because that detent element which does not define the fulcrum for the tensioning lever at the time is swung into a succeeding tooth space of the rack. During the subsequent, opposite pivotal movement of the tensioning lever, the latter is supported by said advanced detect element, which now defines the fulcrum for the lever, so that the other detent element, which is now free, is advanced over one or more teeth of the rack, depending on the selected configuration. During this tensioning movement the tensioning lever will always be backed by the rack by means of one of the two detent elements so that the previously applied tension will be preserved. There is no need for springs urging the tensioning lever against the rack because the previously applied closing tension will pull the tensioning lever against the rack by means of the tension element.

The fastener can be opened in that the detent element which in the swing-down positions of the tensioning lever interengages with the rack is lifted out of the corresponding tooth space whereas the other detent element is not latched. This can be accomplished in a simple manner by a camming surface or a stop provided on the tensioning lever or the rack and ensuring that the tensioning lever will be pivotally moved in such a manner that its two detent elements will be reliably disengaged from the rack.

If the tensile element is not permanently pivoted to the tensioning lever but, e.g., is only hooked into the same, the tensioning lever can be slidably connected to the rack because in such a case the tensioning lever need not be lifted off for a simpler closing operation.

A particularly desirable structure will be obtained if one of the two detent elements is pivoted to the tensioning lever at a point which is spaced from the other detent element, which is known manner is rigidly connected to the tensioning lever. To ensure that during the upswing and downswing of the tensioning lever that detent element which does not define the fulcrum for the tensioning lever at the time can be moved into a succeeding tooth space, the tensioning lever must perform a pivotal movement and a translational one; this can advantageously be effected in that one of the two detent elements is pivoted. When the tensioning lever is supported by the rack at the pivoted detent element, the tensioning movement will cause the tensioning lever to be pivotally moved about the point where the detent element bears on the rack and about the pivot of the detent element so that the free detent element will be displaced as required.

When there is a detent element that is pivoted to the tensioning lever, it must be ensured that that detent element will remain in contact with the rack as the tensioning lever is swung up and down. In order to prevent a disengagement of the pivoted detent element from the rack, that detent element can simply be spring-urged against the rack.

In a simple modified structure the pivoted detent element consists of a loop, which can easily be pivoted to the tensioning lever and constitutes the pivot by which the loop is connected to the rack. Besides, the use of a detent element consisting of a loop offers a simple possibility to ensure a spring bias of the detent element without a need for a separate spring if the laterally bent leg end portions of the loop enter a slot of the tensioning lever and include an angle with the geometrical bearing axis of the loop. As the loop is swung out of its initial position, the laterally bent leg end portions will engage the longitudinal walls of the slot so that the elasticity of the loop and that of the material of the tensioning lever can be utilized. When released, the loop will swung back to its initial position, which is defined by the laterally bent leg end portions in the slot and/or by stops.

It has been stated hereinbefore that the tensile element need not be permanently connected to the tensioning lever but may be hooked into a recess of the tensioning lever. In that case the tensioning lever is not connected to the shoe and may become lost. This can be prevented in that the tensioning lever is slidably mounted on the rack. For this purpose, the tensioning lever may be provided with links which project into longitudinal grooves formed in the side faces of the rack.

According to a further preferred feature of the invention, the loop may be replaced by a detent element which is pivoted to the tensioning lever by a pair of links which are guided in longitudinal grooves formed in the sidefaces of the rack. That pair of links again ensure that the detent element which is rigid with the tensioning lever will perform a translational movement relative to the movable detent element provided with the pair of links so that the detect element rigid with the tensioning lever can be advanced by one tooth space when the movable detent element has been latched and the tensioning lever is pivotally moved. The detent element pivoted to the pair of links will be caused to follow up as the tensioning lever is pivotally moved in the opposite sense about the detent element that is rigid with the tensioning lever. Because the pair of links are guided relative to the rack, the tensioning lever is captively retained and is guided in the proper position for operation.

Such fastener can be opened in a very simple manner if the tensioning lever has a nose which in response to the upswing imparted to the tensioning lever to open the fastener bears against a stop of the detent element pivoted to the pair of links so that the latter detent element is swung out of engagement with the rack.

The retensioning of the fastener can be particularly easily effected by an upswing and downswing of the tensioning lever if no effort is required to advance the tensioning lever as it is swung up. This requires that the tensioning force previously exerted is applied to the rack only by the detent element which defines the fulcrum for the lever. According to a further preferred feature of the invention, this can be accomplished in that the tensile element is pivoted to the pivoted detent element adjacent to the fulcrum defined thereby. As a result, the upswing imparted to the tensioning lever in order to advance the detent element which is rigid with the tensioning lever is not affected by the force acting on the tensile element. Only as the tensioning lever is depressed to retension the fastener is the tensioning lever caused to follow up; the required tensioning force can be applied more easily as the tensioning lever is depressed.

A reliable interengagement of the detent elements with the rack can be ensured without any spring bias of the detent element if the detent element pivoted to the tensioning lever has two stops, which are engageable by the tensile element, which extends between said stops and is pivoted to the tensioning lever. For that purpose the tensile element may act on the tensioning lever at such a point that the pivotal movement of the tensioning lever will cause the tensile element to perform the required movement transversely to the tensioning direction.

In order to ensure that the pivoted detent element will be in the desired initial position under a suitable spring load, a further preferred feature of the invention resides in that the pivotal movement of the pivoted detent element is limited by a stop.

Such stop for limiting the pivotal movement will be essential if both detent elements rather than only one detent element are pivoted to the tensioning lever and are spring-biased. Such embodiment affords the advantage that the additional pivot between the otherwise rigid detent element and the tensioning lever increases the freedom of movement of the tensioning lever so that favorable sequence of operation can be accomplished. Besides, the tensioning lever may be guided by means projections, which extend into longitudinal grooves of the rack in order to prevent an undesired opening of the fastener. Otherwise the tensioning lever might be provided with two pivoted detent elements inadvertently disengaged from the rack.

Finally, the advancing and following up of the detent elements into the tooth spaces of the rack can also be ensured in that each of the two detent elements which define respective fulcrums for the lever are rigidly connected to the tensioning lever and the tensile element which is adapted to be hooked into the rack and extends into a slot which is transverse to the longitudinal axis of the tensioning lever. In that embodiment, the detent elements are advanced in that the tensioning lever is displaced relative to the tensile element. This is permitted by the slot in the tensioning lever. The tensioning lever can be displaced relative to the tensile element during the tensioning movement because the tensile element extends through a tooth space of the rack as the tensioning lever is swung back in preparation for the retensioning and the tensile element extends transversely to the tensioning direction as the tensioning lever is subsequently swung down for tensioning. As the tensioning lever is swung back, the tensile element which engages the slot is pulled over a tooth into the next following tooth spaced and is then caught by said tooth space so that the tensile element will not bias the tensioning lever as the latter is swung up and shifted in the tensioning direction; when the tensioning lever is then depressed once more, the tensile element will be advanced into the next following tooth space.

In that embodiment, the fastener may comprise two detent elements which define respective fulcrums for the tensioning lever, and an additional detent element which is rigid with the tensioning lever, and said detent elements may constitute a gear ring having a tooth pitch which is about one and a half times the tooth pitch of the rack. When the additional detent element is provided, the fastener can be opened in steps so as to gradually decrease the tension. This may be accomplished in that the tensioning lever is pivotally moved from its swung-down position toward the tensile element until the additional detent element enters a tooth space which lies before the tooth space in which the tensile element is caught. As the tensioning loop is swung up, the tensile element is lifted out of the rack and during the opposite movement of the tensioning lever will fall into the next preceding tooth space of the rack so as to reduce the tension. The tensioning lever can then be advanced further and the operation is repeated so that it is possible to reduce the tension with-out entirely eliminating the tension which has been applied.

If the tensile element is held in a slot of the tensioning lever so that the tensioning lever could inadvertently swung up, such inadvertent upswing can be prevented in that the tensioning lever carries knobs, which laterally protrude toward the rack and in response to the downswing of the tensioning lever enter longitudinal grooves formed in the side faces of the rack so that the tensioning lever is held in its swung-down position.

Figure 6:
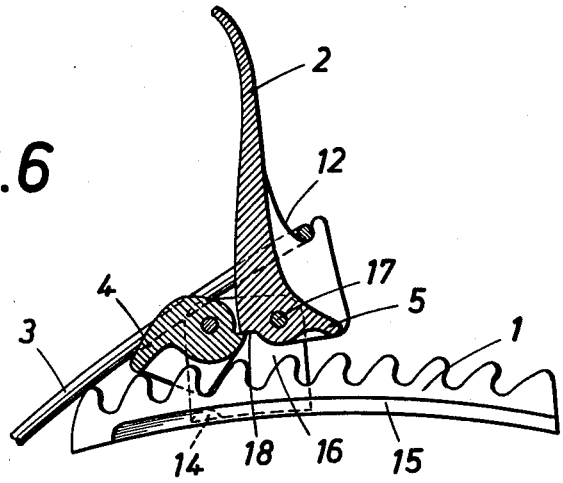
Figure 7:
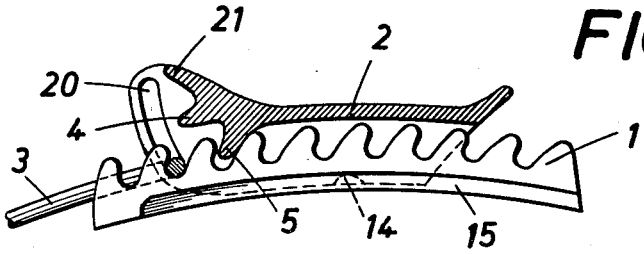
Figure 8:
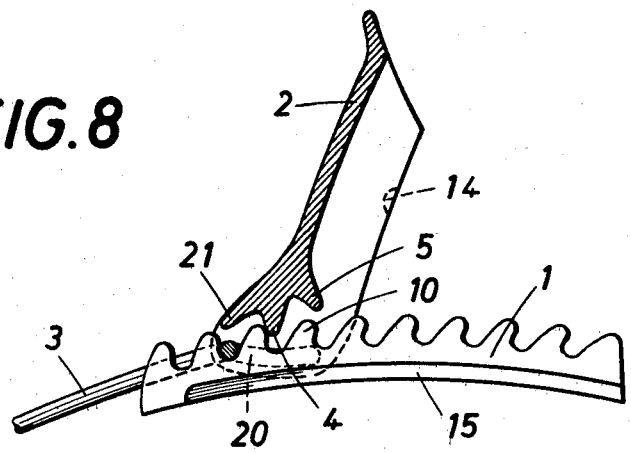
Figure 9:
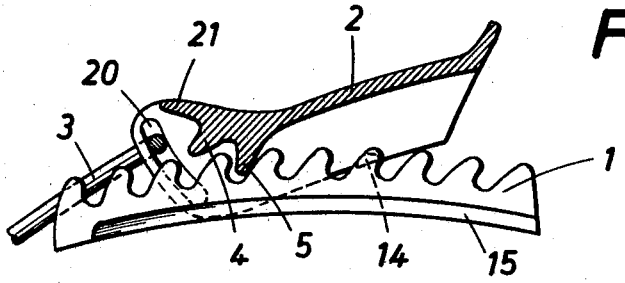
Figure 10:
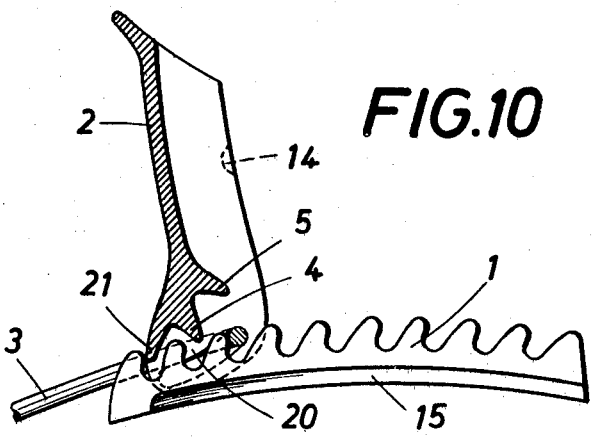
Figure 11:
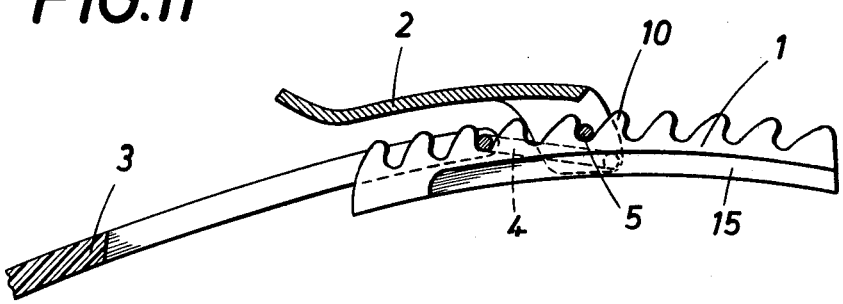
Figure 12:
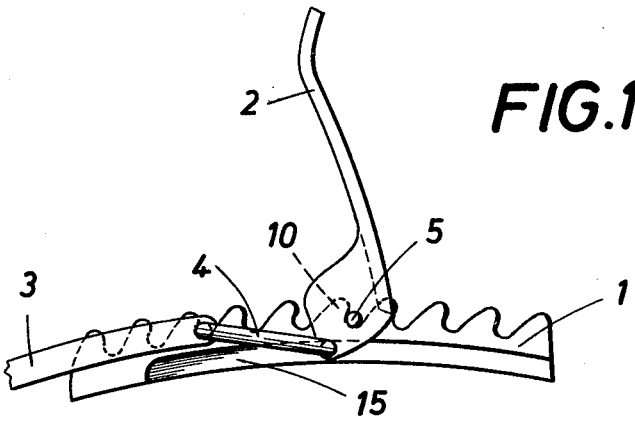
Figure 16:
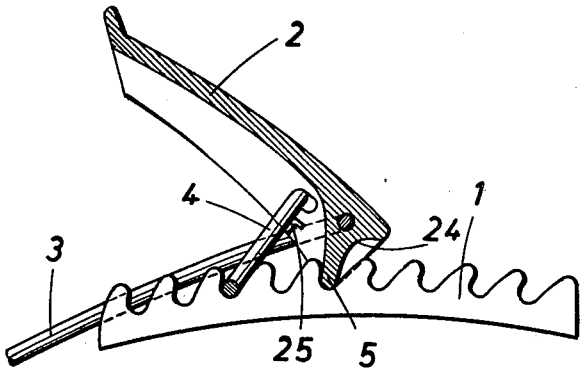
Figure 17:
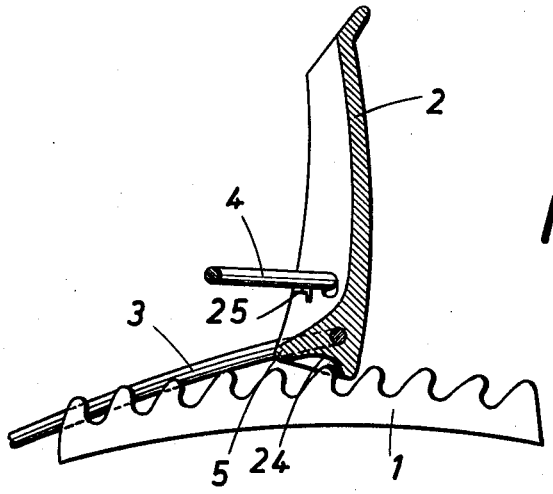
Figure 18:
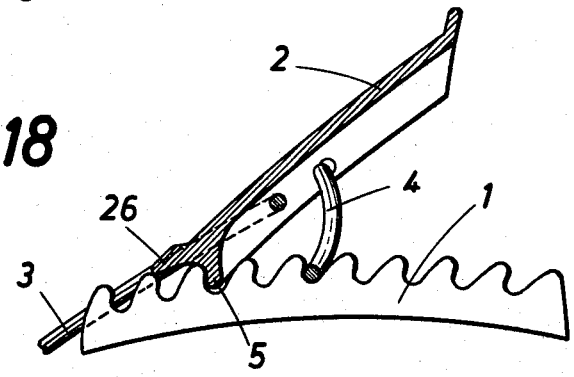
Figure 19:
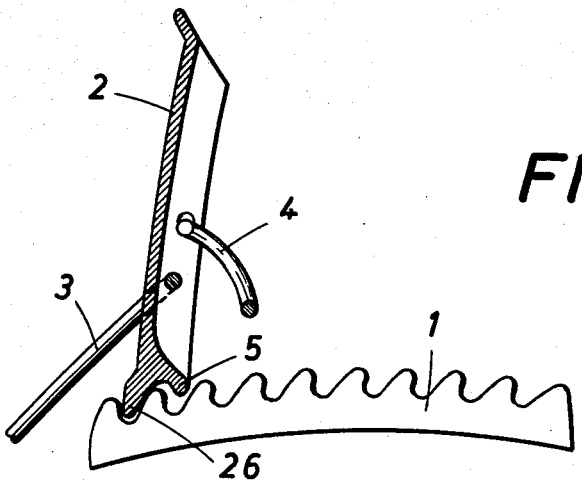

Embodiments of the invention are shown by way of example on the accompanying drawing, in which FIGS. 1 to 3 show a lever-operable fastener according to the invention in different closing positions, FIGS. 1 and 2 being a sectional view and FIG. 3 a side elevation, FIGS. 4 to 6 are longitudinal sectional views showing another embodiment of a lever-operable fastener according to the invention in three operating positions, FIGS. 7 to 10 show a modified lever-operable fastener according to the invention, having rigid detent elements, in different operating positions, FIGS. 11 and 12 are respectively a sectional view and an elevation showing another modified lever-operable fastener according to the invention in different operating positions, FIGS. 16 and 17 show a lever-operable fastener in which the tensioning lever is swung down toward the tensile element, FIGS. 18 to 20 show a lever-operable fastener which is similar to that of FIGS. 16 and 17 but has a tensioning lever which is swung down away from the tensile element, FIG. 20 being a bottom view, and FIGS. 21 and 22 show another modified lever-operable fastener having two pivoted detent elements.

It is apparent from the drawings that the lever-operable fastener comprises a rack 1, which is secured to one of the two parts of the shoe which are to be joined, and a tensioning lever 2, which is acted upon by a tensile element 3, usually a loop, which is connected to the other of said parts of the shoe. Contrary to the known tightener-operable fasteners, the tensioning lever 2 is provided not only with one detent element for cooperating with the rack 1 but is provided with two detent elements 4 and 5, each of which is adapted to define a fulcrum for the tensioning lever 2 and which during the upswing and downswing of the tensioning lever successively interengage with the rack in such a manner that the detent element which does not define a fulcrum at a time is advanced into a succeeding tooth space of the rack 1.

In the embodiment shown in FIGS. 1 to 3, one detent element 4 consists of a loop 6, which has laterally bent legend portions 7 extending into a slot 8 of the tensioning lever. The geometric pivotal axis of the loop 6 includes such an angle with the laterally bent end portions 7 that the loop 6 owing to its inherent elasticity will produce a torque which opposes the pivotal movement of the loop 6 relative to the tensioning lever 2. The resulting spring bias will ensure that the loop 6 will continue to engage the rack 1 as the tensioning lever 2 is swung up and down so that the loop 6 will always interengage with the rack 1 after such downswing.

When the tensioning lever 2 is swung up from the swung-down position shown in FIG. 1 to the position shown in FIG. 2, the tensile element 3 will bias the tensioning lever 2 so that the latter will be suppported by the rack at the loop 6. As a result, the crosspiece 9 of the loop 6 will define a fulcrum for the upswing of the tensioning lever 2. In addition, the tensioning lever 2 is pivotally moved relative to the loop 6 about the leg end portions 7 thereof so that the detent element 5 formed by a pin is advanced over the tooth 10 of the rack 1 into the next following tooth space in the tensioning direction. When the tensioning lever 2 is then swung down, its fulcrum will be defined by the detent element 5 and the loop 6 will be advanced to the next following tooth space. It is apparent that the fastener can be retensioned by a repeated upswing and downswing of the tensioning lever 2 without a need to reduce the tension previously applied.

When it is desired to open the fastener, the tensioning lever 2 is forced down toward the rack 1 beyond the position to which the lever 2 is swung down to close the fastener. As a result the camlike elevation 11 on the underside of the tensioning lever 2 causes the adjacent end of the tensioning lever to be swung up and the detent elements 4 and 5 to be pulled out of the tooth spaces of the rack. The interengagement has thus been eliminated and the fastener has been opened.

The tensile element 3 might be non-detachably pivoted to the tensioning lever 2. This is not the case in the embodiment shown by way of example, where the tensile element 3 is hooked into a recess 12 of the tensioning lever 2, which in that case would be a loose part of the fastener. To avoid the use of such loose parts, links 13 are pivoted to the tensioning lever 2 and overlap the rack 1 and carry knobs 14, which laterally project toward the rack and extend into respective longitudinal grooves 15 formed in respective side faces of the rack. These links 13 ensure that the tensioning lever 2 will be slidably guided relative to the rack 1 with sufficient freedom of movement so that the detent elements 4 and 5 can be disengaged from the rack 1, as is shown in FIG. 3.

The lever-operable fastener shown in FIGS. 4 to 6 differs from that shown in FIGS. 1 to 3 in that the detent element is not directly pivoted to the tensioning lever 2 but is pivoted to the latter by a pair of links 16. In this case the tensioning lever 2 as it is swung up is pivotally moved about the pivot 17 which connects the pair of links 16 to the tensioning lever so that the link 16 is raised and the detent element 5 is moved over the tooth 10 of the rack 1 and then caught by the next following tooth space. As the tensioning lever 2 is depressed from the position shown in FIG. 5, the detent element 4 is also advanced into the next following tooth space. That fastener can also be retensioned while tension is maintained. The tensioning lever 2 is guided relative to the rack 1 by means of the pair of links 16, which carry knobs 14 sliding in longitudinal grooves 15 formed in respective side faces of the rack 1.

To open the fastener, the tensioning lever 2 carries a nose 18, which during the upswing of the tensioning lever bears against a stop 19 of the detent element 4 and lifts the latter out of the tooth space, as is shown in FIG. 6.

In accordance with FIGS. 7 to 10, the detent elements 4 and 5 of the tensioning lever 2 are rigidly connected to the latter. In that case the tensile element 3 must extend through a slot 20, which is transverse to the longitudinal axis of the tensioning lever 2. Besides, the tensile element itself extends through the rack so that it will not stress the tensioning lever 2 as the latter is actuated. When the tensioning lever 2 is held in its swing-down position by knobs 14 which have snapped into longitudinal grooves 15 formed in respective side faces of the rack 1, and it is then desired to retension the fastener, the tensioning lever is to be swung up and pressed forward. As a result, the tensile element which is retained in the rack 1 is displaced in the slot 20 relative to the tensioning lever 2. That displacement of the tensioning lever 2 permits the detent element 4 to enter the following tooth space (FIG. 8) so that the subsequent downswing of the tensioning lever 2 will cause the same to roll on the detent element 4 until the second detent element 5 has been moved over the tooth 10 of the rack into the next following tooth space and the tensile element 3 is then pulled into the next tooth space. This can be accomplished because the slot 20 is transverse to the longitudinal axis of the tensioning lever so that the tensile force acting on the tensile element causes the latter to slide in the slot into the next following tooth space. An additional detent element is provided for opening the fastener and together with the remaining detent elements 4 and 5 virtually constitutes a gear ring having a tooth pitch which is about one and half times the tooth pitch of the rack. When the tensioning lever is swung from its closing position shown in FIG. 7 to the position shown in FIG. 10, the additional detent element 21 enters a tooth space and the tensioning lever 2 can then be pivotally moved about the detent element 21. As a result, the tensile element 3 is lifted out of the tooth space through which it then extends and under its tensile force falls into the next following tooth space of the rack because the slot 20 permits a corresponding movement of the tensile element. When the tensioning lever 2 falls into the position shown in FIG. 10 and has been additionally displaced within the extent permitted by the slot 20, the detent element 21 will reach a new tooth space and the operation can then be repeated. It is apparent that the tension of the fastener can be reduced in steps by means of the additional detent element 21. When the tensioning lever 2 is completely turned over toward the tensile element 3, the latter will be lifted out of the rack 1 beyond return. In this way the fastener can be entirely opened at once.

In accordance with FIGS. 11 and 12 the tensile element 3, e.g., a tension strap, is not directly pivoted to the tensioning lever 2 but to the detent element 4, which consists of a loop. Because the tensile element is pivoted to that portion of the detent element 4 which enters the rack 1, the detent element 4 will be relieved during the upswing of the tensioning lever 2 so that such upswing does not require a substantial effort. During the upswing of the tensioning lever 2, the latter is supported at the detent element 4 so that the detent element 5 which is rigid with the tensioning lever 2 will jump over the tooth 10 of the rack 1. As the tensioning lever 2 is depressed, the detent element 4 will pull forward the tensile element 3 by one tooth while the tensioning lever 2 is supported on the rack 1 at the detent element 5.

Figure 13:
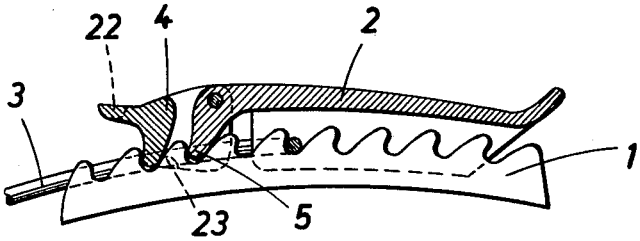
Figure 14:
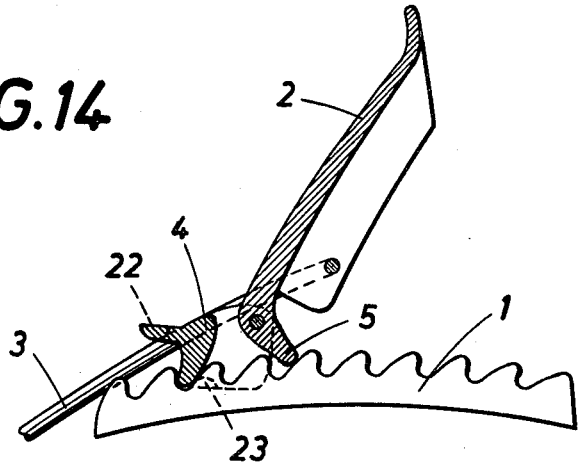
Figure 15:
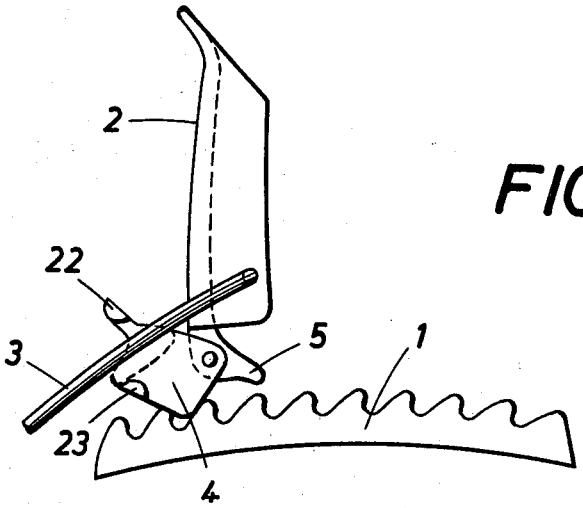

In the embodiment of a lever-operable fastener shown in FIGS. 13 to 15 the movable detent element 4 need not be spring-biased. The detent element 4 is substantially U-shaped in cross-section and at its legs is pivoted to the tensioning lever 2 whereas its crosspiece enters the rack 1. The detent element 4 is provided on opposite sides with laterally protruding stops 22 and 23. The legs of the loop serving as a tensile element 3 extend between the stops 22 and 23. When the lever 2 has been swung down, as is shown in FIG. 13, the tensile element 3 bears on the stops 23 which face the shoe so that the detent element 4 carried by the tensioning lever bears on the rack 1. Retensioning is effected in accordance with FIG. 14 in a manner which is similar to the retensioning of the embodiment shown in FIGS. 4 to 6. Such retensioning causes the stop 23 to be released so that the detent element 4 can be pulled over the next following tooth into the succeeding tooth space. The stop 22 must not yet be effective at this stage. Only when the fastener is to be opened, as shown in FIG. 15, in that the tensioning lever 2 is swung up beyond the retensioning position, will the tensile element 3 bear on the stops 22 so that the detent element 4 is lifted out of the rack 1 and the fastener is thus opened.

The lever-operable fastener shown in FIGS. 16 and 17 is closed toward the tensile element. During its closing movement, the tensioning lever 2 is supported on the rack by means of the detent element 4, which consists of a spring-biased loop, whereas the detent element 5 which is rigid with the tensioning lever is pushed over the next following tooth into the next following tooth space. The detent element 4 is pulled forward as the tensioning lever 2 is swung up. To open the fastener, the tensioning lever 2 is pivotally moved to the position which is shown in FIG. 17 and in which the camming surface 24 of the tensioning lever causes the detent element 5 to be disengaged from the rack 1. The pivotal movement of the detent element 4 is limited by the stop 25 carried by the tensioning lever 2 so that the interengagement of the detent element 4 with the rack 1 is continued. When the torque exerted by hand on the tensioning lever 2 is reduced, the tensile force exerted by the tensile element 3 will swing back the tensioning lever 2 sufficiently for the detent element 5 to fall into the next following tooth space so that the tension applied by the fastener can be reduced in steps.

The embodiment shown in FIGS. 18 to 20 differs from the embodiment shown in FIGS. 16 and 17 only in that the tensioning lever 2 must be depressed away from the tensile element 3 when it is desired to close the fastener. For this reason, the fastener is opened by means of a nose 26, which constitutes another detent element and on which the tensioning lever 2 rolls, as shown in FIG. 19. If the distance from the detent element 5 to the nose 26 is about one and a half times or two, three . . . and a half times the tooth pitch of the rack 1, then it will be possible to reduce the tension in steps because the tensioning lever can be swung down from the position shown in FIG. 19 to a position such as is indicated in FIG. 18 and in which the nose 26 lies on the next following tooth so that another upswing of the tensioning lever will cause the nose 26 to be pulled forward over that tooth into the next following tooth space.

In the bottom view of the tensioning lever 2 in FIG. 20 it is clearly apparent that the laterally bent leg end portions 7 of the loop-shaped detent element 4 extend into the slots 8 of the tensioning lever 2 and include an angle with the bearing axis. As a result, a pivotal movement of the loop will cause the latter to be deformed by the end portions 7 so that the desired restoring force is ensured.

Finally both detent elements 4 and 5 of the lever-operable fastener shown in FIGS. 21 and 22 consist of loops and are pivoted to the tensioning lever. The detent elements 4 and 5 are spring-biased against stops 27 and 28 in order to limit the pivotal movement. The mode of operation of this fastener is similar to that of the fasteners described hereinbefore. As the tensioning lever 2 is forcibly swung down to the position shown in FIG. 21, the tensioning lever 2 supported at the detent element 4 is advanced in the tensioning direction along the rack 1 because the detent element 4 and the tensioning lever 2 virtually constitute a toggle joint. The detent element 5 is carried along and moved over the following tooth and under its spring bias snaps into the next tooth space of the rack 1. When the tensioning lever is subsequently swung up, the detent element 4 is pulled forward into the next following tooth space and the initial situation is restored. The fastener can be opened in that the tensioning lever 2 is swung up into the opening position which is shown in FIG. 22 and in which the stops 27 and 28 cause the detent elements 4 and 5 to be disengaged from the rack 1.

In that embodiment the tensile element 3 is only hooked into the tensioning lever 2. In order to prevent a loss of the tensioning lever 2, the latter is guided by means of knobs 14, which protrude laterally toward the rack 1 and extend into longitudinal grooves 15 of the rack, as has been described hereinbefore in connection with other embodiments. This guidance of the tensioning lever prevents a lifting of the tensioning lever 2 from the rack 1 adjacent to the detent element 5 as the tensioning lever is swung up because this would cause an opening of the fastener or a decrease of the tension.

What is claimed is:

1. In a lever-operable fastener for pulling two parts of a shoe toward each other, comprising a rack which is secured to one of said parts and extends toward the other of said parts and has a series of teeth spaced apart along said rack and tooth spaces between said teeth, a tensioning lever which is adapted to be swung up from and down to said rack and carries a first detent element adapted to enter one of said tooth spaces so as to define a first fulcrum for said lever, and a tensile element which is connected to the other of said parts and adapted to exert tension on said lever at a point spaced from said first detent element, said lever being movable along said rack in a predetermined tensioning direction to apply a higher tension through the intermediary of said tensile element and rack to said two parts, the improvement residing in that said tensioning lever carries a second detent element, which is spaced along said rack from said first detent element and adapted to enter one of said tooth spaces so as to define a second fulcrum for said lever.

one of said detent elements is adapted to enter one of said tooth spaces and to define a fulcrum for said lever as the latter is swung up, and to disengage and be clear of said rack as said lever is swung down, the other of said detent elements is adapted to enter one of said tooth spaces and to define a fulcrum for said lever as the latter is swung down, and to disengage and be clear of said rack as said lever is swung up, and said tensioning lever is adapted to move each of said detent elements when the same is clear of said rack into a succeeding one of said tooth spaces in said tensioning direction as said tensioning lever is swung up and swung down.

2. The improvement set forth in claim 1, wherein said first detent element is rigid with said lever and said second detent element is pivoted to said lever.

3. The improvement set forth in claim 2, wherein said second detent element is spring-urged against said rack.

4. The improvement set forth in claim 2, wherein two links are provided on opposite sides of said tensioning lever and on opposite sides of said second detent element, each of said links is pivoted on a first axis to said lever and on a second axis to said second detent element, said rack has mutually opposite side faces formed with respective longitudinal grooves, and each of said links is guided in one of said grooves.

5. The improvement set forth in claim 4, wherein said second detent element comprises a stop, said lever is provided with a nose and is adapted to be swung up to a predetermined extent, and said nose is arranged to bear on said stop and to swing said second detent element clear of said rack when said lever is swung up to said predetermined extent.

6. The improvement set forth in claim 2, wherein said tensile element is pivoted to said second detent element adjacent to said second fulcrum.

7. The improvement set forth in claim 2, wherein said second detent element comprises two laterally stops, said tensile element is pivoted to said lever and extends between and is engageable with said stops and is arranged to force said second detent element by means of one of said stops against said rack as said lever is swung down and to disengage said second detent element from said rack as said lever is swung up.

8. The improvement set forth in claim 2, comprising stop means for limiting the pivotal movement of said second detent element.

9. The improvement set forth in claim 2 wherein said lever is formed with a slot, said second detent consists of a loop, the loop having laterally bent leg end portions extending into said slot so as to define a geometric bearing axis and said leg end portions include an angle with said axis.

10. The improvement set forth in claim 1, wherein both said detent elements are pivoted to said lever and are spring-urged toward said rack and stop means are provided for limiting the pivotal movement of each of said detent elements.

11. The improvement set forth in claim 1, wherein both said detent elements are rigid with said lever, said lever is formed with a slot which is transverse to the longitudinal axis of said lever, and said tensile element is hooked into said rack and extends through said slot in relative sliding engagement between said lever and said tensile element.

12. The improvement set forth in claim 11, wherein at least one additional detent element is provided, which is rigid with said lever and said first, second and at least one additional detent elements constitute a gear ring having a tooth pitch which is about one and a half times the tooth pitch of the rack.

13. The improvement set forth in claim 11, wherein said rack has opposite side faces formed with respective longitudinal grooves and said lever has knobs which laterally protrude towards opposite sides of said rack and are adapted to enter said grooves as said lever is swung down.

* * * * *